US005559302A

United States Patent [19]

Latka

[11] Patent Number: 5,559,302

[45] Date of Patent: Sep. 24, 1996

[54] BAYONET TYPE COUPLING FOR FIREARMS

[75] Inventor: Gregory S. Latka, Jackson, Mich.

[73] Assignee: GSL Technology, Inc., Jackson, Mich.

[21] Appl. No.: 522,016

[22] Filed: Aug. 31, 1995

[51] Int. Cl.[6] ..... F41A 21/32

[52] U.S. Cl. ..... 89/14.05

[58] Field of Search ..... 42/75.02, 79, 86, 42/105; 89/1.34, 14.05, 14.2, 14.3, 14.4, 14.5, 14.6; 181/223; D22/108

[56] References Cited

U.S. PATENT DOCUMENTS 4,893,426 1/1990 Bixler ..... 42/75.01

5,433,133 7/1995 LaFrance ..... 89/14.2

FOREIGN PATENT DOCUMENTS 649929 9/1937 Germany ..... 89/14.6

*Primary Examiner*—Stephen C. Bentley

*Attorney, Agent, or Firm*—Duncan F. Beaman

[57] ABSTRACT

A coupling for removably mounting accessories on the end of a gun barrel wherein the gun barrel includes at least one lug spaced from the barrel end. A coupling adapter receives the gun barrel end and lugs and includes lug retaining recesses which receive the lugs upon relative rotation between the gun barrel and adapter occurring. A compressible spring located within the adapter biases an annular lug engaging sleeve wherein lug retention within the adapter recesses is maintained by the spring and only an axial movement of the adapter on the gun barrel is required to disengage the lug and its retaining recess to permit rotation of the adapter for quick adapter mounting and removal.

6 Claims, 2 Drawing Sheets

BAYONET TYPE COUPLING FOR FIREARMS

BACKGROUND OF THE INVENTION

1. Field of the Invention

The invention pertains to a bayonet type coupling for mounting a firearm accessory adapter upon a gun barrel characterized by its ability to quickly mount and remove the adapter, and yet produce a positive effective mechanical lock of the adapter on the gun barrel.

2. Description of the Related Art

It is often desirable to mount an accessory such as a flash suppressor, silencer, grenade launcher, blank adapter, or the like, upon the end of gun barrels. Such accessories are usually mounted upon an adapter which constitutes a coupling for attaching the accessory to the gun barrel. This invention particularly pertains to gun barrels having one or more radially extending lugs formed on the barrel axially spaced from the barrel end. Such lugs are commonly found upon several makes of automatic firearms, such as submachine guns.

It is known to utilize firearm accessory adapters which include an opening receiving the end of the gun barrel and lugs wherein the adapter includes lug retaining recesses which align with and retain the lugs upon relative rotation of the adapter and the gun barrel occurring after the adapter has been fully axially positioned upon the gun barrel. Adapters of this type are shown in U.S. Pat. Nos. 4,893,426 and 5,433,133 wherein the lugs are retained within the lug receiving recesses formed in the adapter by a threaded lock member.

The use of a threaded lock member to maintain the lugs within the adapter lug retaining recesses requires several steps of operation to mount the adapter on the gun barrel, cannot easily be accomplished with one hand, and the possibility of the adapter loosening on the barrel exists in the event the threaded lug locking member unloosens due to vibration occurring during firearm operation.

OBJECTS OF THE INVENTION

It is an object of the invention to provide a coupling for a firearm accessory adapter which may quickly be mounted upon a gun barrel having radial extending lugs wherein only axial and rotative one hand movement is required to mount and lock the adapter on the barrel.

Another object of the invention is to provide a bayonet type coupling for a firearm accessory adapter wherein the gun barrel includes radial extending lugs, and the adapter includes an opening receiving the gun barrel end region and lugs, and lug retaining recesses which align with the lugs upon rotation of the gun barrel relative to the adapter, and wherein a spring biasing force is utilized to maintain the lugs within their adapter retaining recesses.

Yet another object of the invention is to provide a coupling for a firearm accessory adapter of the bayonet type wherein a compression spring mounted within the adapter biases a lug engaging sleeve reciprocally and axially mounted within the adapter such that the spring biased sleeve maintains the lugs within lug retaining recesses formed in the adapter.

SUMMARY OF THE INVENTION

The adapter coupling of the invention is for use with gun barrels having one or more radially extending lugs located upon the gun barrel spaced from the gun barrel end. The accessory adapter includes a bore, one end of which is sized and configured to receive the gun barrel end and lugs. Necessarily, the adapter opening includes radially extending notches conforming to the configuration of the lugs, and internally, the adapter includes lug receiving and retaining recesses which will align with the lugs upon relative rotation occurring between the gun barrel and adapter.

Maintaining of the lugs within the adapter lug recesses is achieved by an axially displaceable sleeve located within the adapter bore which engages the forward face or end of the lugs wherein the sleeve will be displaced as the gun barrel end and lugs are received within the adapter bore and opening.

An annular compression spring located within the adapter biases the sleeve toward the adapter opening and the spring will be compressed as the gun barrel end is received within the adapter bore. Compression of the spring, and displacement of the sleeve, continues until it is possible to rotate the adapter relative to the gun barrel and align the lugs with the lug retaining recesses formed in the adapter. Thereupon, release of the manual force being exerted upon the adapter to compress the spring permits the spring to displace the sleeve and force the lugs into the adapter recesses mechanically locking the adapter upon the gun barrel. As the biasing force is continually imposed upon the lugs and adapter, vibration will not cause accidental disengagement of the adapter from the lugs, and the mounting of the adapter on the gun barrel is quick, firm, positive, and vibration releasing proof.

When it is desired to remove the accessory adapter from the gun barrel, the operator merely axially displaces the adapter on the gun barrel by pushing the adapter toward the lugs which compresses the spring and permits relative rotation between the gun barrel and adapter to occur to align the lugs with the adapter opening notches and the adapter may be quickly easily removed from the gun barrel.

Accordingly, in the practice of the invention, only one hand operation is necessary to mount the adapter and gun barrel accessory upon the gun barrel or remove the same therefrom, and this operation may be quickly accomplished requiring very little skill, and yet a firm and vibration proof mounting of the accessory upon the gun barrel is achieved.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
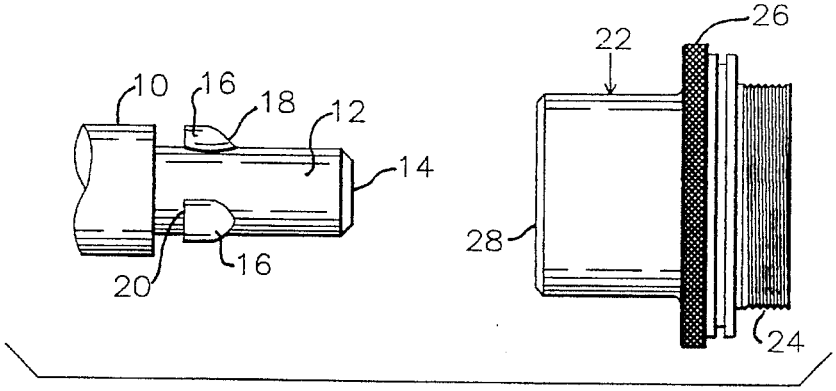
FIG. 1 is a partial exploded view of a gun barrel having a firearm accessory adapter aligned therewith prior to mounting of the accessory on the gun barrel.

In FIG. 1, a gun barrel is represented at 10, such gun barrel usually being of the automatic or submachine gun type and includes a cylindrical end region 12 having an end 14 which is intersected by the gun barrel bore, not shown. Three lugs 16 are mounted upon the barrel end region 12 radially extending therefrom, and axially spaced back from the barrel end 14 as appreciated in FIG. 1. The lugs 16, in most embodiments, are three in number spaced 120° from each other about the end region circumference, and each lug includes an oblique front face 18, and a rear shoulder 20 substantially perpendicularly disposed to the longitudinal axis of the barrel 10.

The adapter 22 is shown in axial alignment with the gun barrel 10 in FIG. 1, and the purpose of the adapter 22 is to permit an accessory such as a flash suppressor, silencer, grenade launcher, or the like, to be mounted upon the muzzle end of the barrel 10. Externally, the adapter 22 includes threads 24 upon which the accessory, not shown, is threaded, and handling and gripping of the adapter 22 is facilitated by the knurled finger ring 26.

Figure 3:
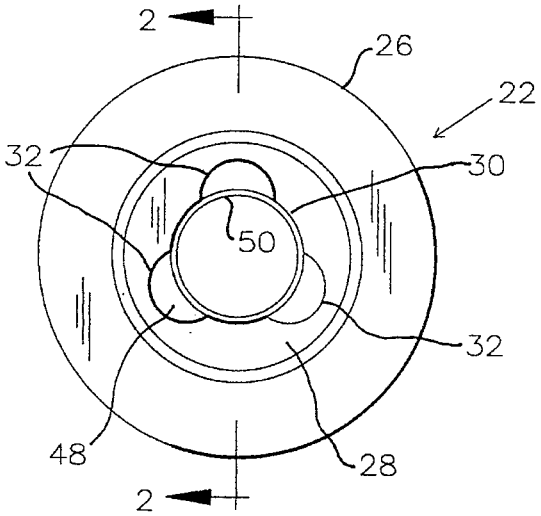
FIG. 3 is an end elevational view of the adapter illustrating the adapter opening as taken along Section 3—3 of FIG. 2.

The adapter end 28 is formed with a circular opening 30, FIG. 3, which is intersected by three notches 32 circumferentially spaced 120° from each other and of such configuration and size as to receive the lugs 16.

Internally, the adapter includes a cylindrical bore 34 having a shoulder 36 and internal threads 38. An annular collar 40, FIG. 2, having threads engaging the adapter threads 38, is threaded into the adapter bore 34 and is of complementary shape and configuration and the inner end of the collar abuts against the shoulder 36.

The collar 40 includes a cylindrical bore 42 and a larger cylindrical surface defining a chamber 44 which forms shoulder 46.

An annular sleeve 48 is axially slidably supported within the adapter 22 and collar 40, and the sleeve 48 includes a cylindrical bore 50 of a diameter slightly larger than the diameter of the gun barrel end region 12 so that the gun barrel end region may be received therein. The sleeve 48 includes a cylindrical stem 52 slidably received within the collar bore 42 and an annular O ring within a groove in the collar provides a seal between the collar and sleeve stem.

Figure 2:
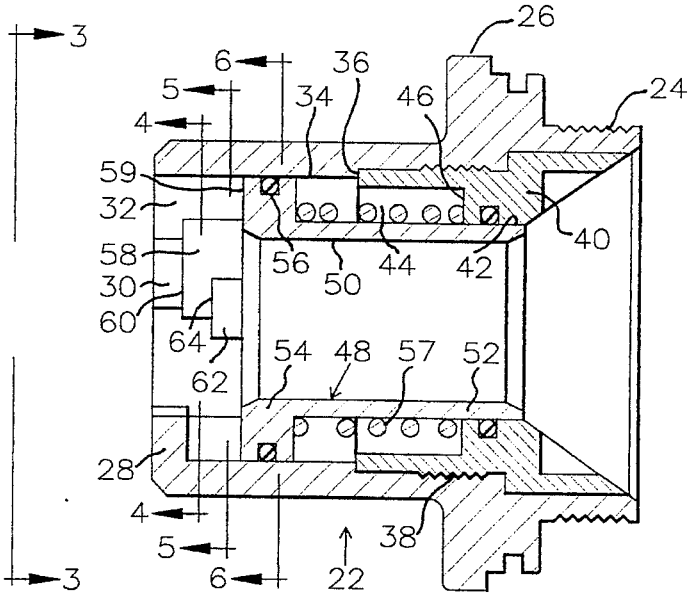
FIG. 2 is a diametrical sectional view of the adapter as taken along Section 2—2 of FIG. 3, the sleeve spring being shown in its extended position.

The sleeve 48 also includes an enlarged circular head 54 having an annular O ring seal 56 to establish a sealing relationship between the head 54 and the adapter bore 34. A compression spring 57 located within the collar chamber 44 is compressed between the collar shoulder 46 and the sleeve head 54, and axially biases the sleeve 48 toward the left as shown in FIG. 2. Axial movement of the sleeve 48 toward the adapter end 28 is limited by engagement of the sleeve head 54 with the shoulder 59 defined within the adapter bore.

Figure 4:
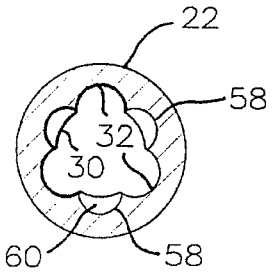
FIG. 4 is a reduced scale elevational sectional view taken through the adapter along Section 4—4 of FIG. 2.
Figure 5:
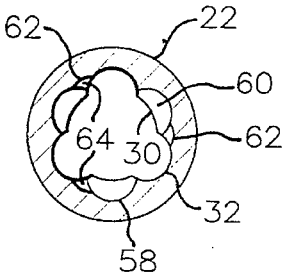
FIG. 5 is an elevational sectional view of the adapter as taken along Section 5—5 of FIG. 2.
Figure 6:
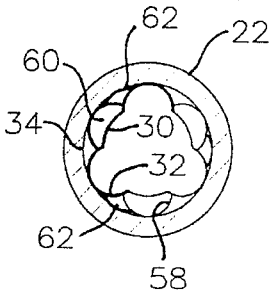
FIG. 6 is an elevational sectional view of the adapter as taken along Section 6—6 of FIG. 2, the sleeve head not being illustrated.

Three lug retaining recesses 58 are defined in the adapter end 28 located at 120° intervals from each other and located intermediate the notches 32, as will be appreciated from FIGS. 4–6. Each of the lug retaining recesses 58 includes a blind bottom 60 as shown in FIGS. 2 and 4.

As best appreciated from FIG. 5, three lug transfer notches 62 are also defined in the adapter end 28 intermediate a notch 32 and a retainer recess 58. The radial dimension of the transfer notches 62 is such as to accommodate the diameter of the lugs 16, and the transfer notches are limited in depth by their surface 64, shown in FIG. 2.

Figure 7:
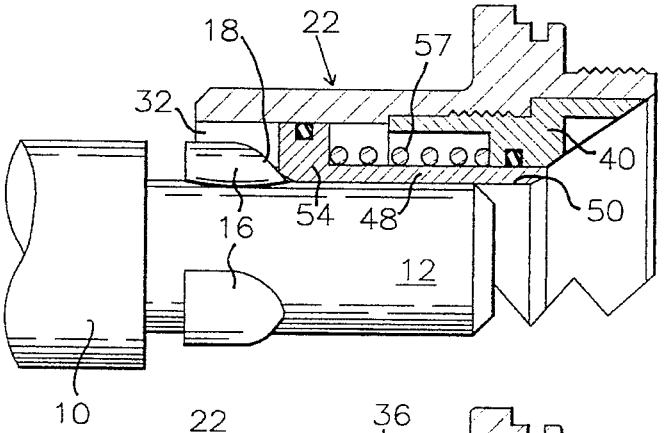
FIG. 7 is a detail elevational adapter half view partially in section illustrating the relationship of the components during initial entry of the gun barrel into the adapter and prior to displacement of the adapter sleeve.

When it is desired to mount the adapter 22 upon the gun barrel 10, the adapter is coaxially aligned with the gun barrel 10 as shown in FIG. 1 wherein the longitudinal axes of the gun barrel and adapter are coaxial. The barrel end region 12 is inserted into the adapter opening 30 and received within the sleeve bore 50 as shown in FIG. 7. As the end region 12 is inserted into the sleeve bore to a greater depth, the lugs 16 are aligned with the adapter opening notches 32 permitting the lugs to enter the adapter and the lug front faces 18 will engage the sleeve head 54 as shown in FIG. 7.

Figure 8:
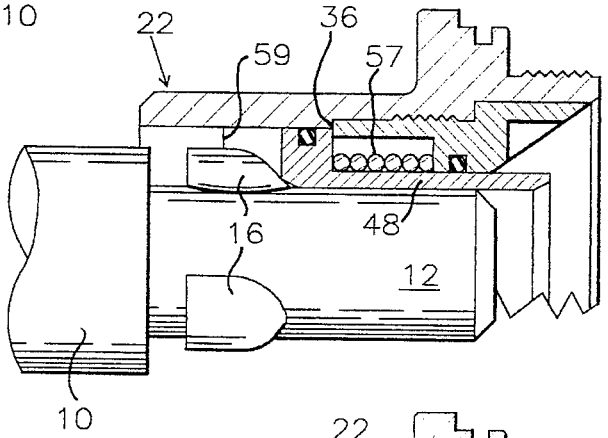
FIG. 8 is a view similar to FIG. 7 illustrating full insertion of the gun barrel into the adapter.

Continued axial movement between the gun barrel 10 and the adapter 22 displaces the sleeve 48 to the right within the adapter 22 as shown in FIG. 8, and this displacement will continue until the sleeve head 54 engages the innermost end of the collar 40. At this time, the lugs 16 have been sufficiently received within the adapter end 28 to a depth so that the inner lug rear shoulders 20 clear the transfer notch bottoms 64 and relative rotation between the gun barrel 10 and the adapter 22 can now be achieved. Relative rotation occurs for 60° until the lugs 16 engage the far edges of the retainer recesses 58. At this time, the lugs 16 will now be in alignment with a retainer recess 58 and the operator will release the axial force being imposed between the gun barrel and adapter which has compressed spring 57 permitting the biasing force of the spring to displace the sleeve 48 to the left, FIG. 9, fully locating the lugs 16 within the retainer recesses 58 and causing the lug rear shoulders 20 to engage the retainer recess bottoms 60.

From FIG. 2, it will be appreciated that the retainer recess 58 is axially located further to the left than the transfer notch bottom 64, and the full reception of the lugs 16 in the retaining recesses 58 will now prevent relative rotation between the gun barrel 10 and the adapter 22. The adapter 22 is now firmly mechanically mounted upon the gun barrel 10 and relative rotation between the gun barrel and adapter is prevented by the reception of the lugs 16 within the retainer recesses 58. As the biasing force maintaining the lug rear shoulders 20 against the retainer recess bottoms 64 is constant and positive, vibration will not release, loosen or adversely affect the mounting of the adapter 22 on the gun barrel 10 and torque imposed upon the adapter 22 during firing or as accessories are threaded upon or unthreaded on the adapter threads 24 will not tend to affect the mounting of the adapter on the gun barrel.

Figure 9:
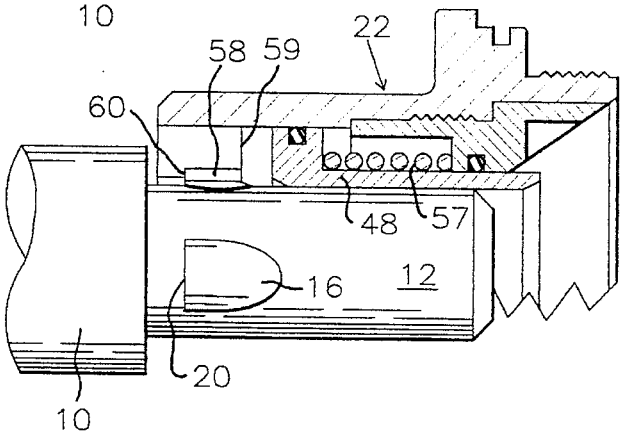
FIG. 9 is an elevational sectional view similar to FIG. 8 illustrating the relationship of the components after relative rotation between the gun barrel and adapter has occurred and the lugs aligned with and received within the adapter lug receiving recesses wherein the sleeve is maintaining the lugs within the recesses.

When it is desired to remove the adapter 22 from the gun barrel 10, the operator grasps the finger ring 26 and axially displaces the adapter 22 to the left, FIGS. 7–9, to compress the spring 57 as shown in FIG. 8. The adapter 22 may then be rotated relative to the gun barrel 10 in view of the alignment of the lugs 16 with the transfer notches 62, and upon the lugs 16 being aligned with the adapter opening notches 32, the adapter may be easily removed from the gun barrel end region 12.

It will be appreciated that mounting of the accessory adapter 22 upon the gun barrel 10 is merely a matter of placing the adapter upon the gun barrel, producing relative displacement therebetween to compress the spring 57, rotating the adapter and gun barrel relative to each other to align the lugs and retainer recesses, and releasing the axial force imposed upon the adapter, or gun barrel, to permit the lugs to be locked within the recesses 58. Accordingly, one hand mounting of the adapter on the gun barrel is produced, and can be very quickly achieved by an unskilled operator.

It is appreciated that various modifications to the inventive concepts may be apparent to those skilled in the art without departing from the spirit and scope of the invention.

I claim:

1. A bayonet type coupling to removably coaxially attach accessories to a gun barrel wherein the gun barrel includes an end, an end region, an exterior surface and a radially extending lug defined on the end region axially spaced from the end having a forward edge facing the barrel end and a rear edge facing away from the barrel end, an accessory adapter having an axis, accessory mounting means, an axial bore, an inner barrel receiving end, a lug receiving opening defined in the adapter inner end, and a lug retaining recess defined in the adapter bore retaining the lug upon insertion of the lug within the opening and rotating the adapter and barrel relative to each other about the adapter axis, the improvement comprising, a sleeve within the adapter bore axially displaceable between first and second positions, a bore with said sleeve receiving the gun barrel end and end region upon being inserted into the adapter opening, an abutment defined upon said sleeve engaging the lug forward edge upon insertion of the barrel end region into the sleeve bore to displace said sleeve from said first position to said second position, and a spring biasing said sleeve toward said first position, said sleeve retaining the lug within the adapter lug retaining recess under the force of said spring.

2. In a bayonet type coupling as in claim 1 wherein three radially extending lugs are defined on the gun barrel end region circumferentially spaced from each other and three lug retaining recesses are defined within the adapter bore.

3. In a bayonet type coupling as in claim 1, said sleeve comprising a tubular element having a reduced diameter cylindrical stem and an enlarged diameter cylindrical head, said sleeve head defining said abutment, and said spring encircling said stem.

4. In a bayonet type coupling as in claim 3, a seal defined in said sleeve head sealingly engaging said adapter bore at all axial positions of said seal.

5. A bayonet type coupling to removably coaxially attach accessories to a gun barrel wherein the gun barrel includes an end, an end region, an exterior surface and a radially extending lug defined on the end region spaced from the end having a forward edge facing the barrel end and a rear edge facing away from the barrel end, an accessory adapter having an axis, accessory mounting means, an axial bore, an inner barrel receiving end, a lug receiving opening defined in the adapter inner end, and a lug retaining recess defined in the adapter bore retaining the lug upon insertion of the lug within the opening and rotating the adapter and barrel relative to each other about the adapter axis, the improvement comprising, a spring within the adapter imposing an axial biasing force substantially parallel to the adapter axis, the lug forward edge compressing said spring upon the lug entering the adapter opening, said spring biasing the lug into the lug retaining recess upon alignment thereof and maintaining the lug within the lug retaining recess.

6. In a bayonet type coupling as in claim 5, said spring comprising a coil compression spring concentrically related to the adapter bore.

* * * * *